US005525014A

United States Patent [19]

Brown

[11] Patent Number: 5,525,014

[45] Date of Patent: Jun. 11, 1996

[54] HORIZONTALLY-YIELDING EARTH STABILIZING STRUCTURE

[76] Inventor: Richard L. Brown, 13453 County Rd. 1, Fairhope, Ala. 36532

[21] Appl. No.: 270,436

[22] Filed: Jul. 5, 1994

[51] Int. Cl.[6] ..... E02D 29/02

[52] U.S. Cl. ..... 405/262; 405/272

[58] Field of Search ..... 405/259.1, 259.4, 405/262, 272, 279, 284; 403/32; 52/604, 712, 714, 167.1, 167.3, 167.4

[56] References Cited

U.S. PATENT DOCUMENTS 4,470,728 9/1984 Broadbent ..... 405/284
5,375,382 12/1994 Weidlinger ..... 52/167.3

*Primary Examiner*—William P. Neuder
*Attorney, Agent, or Firm*—Veal & Marsh

[57] ABSTRACT

A connector for use in constructing an earth stabilizing structure with the capability of yielding horizontally to excessive impact loads. The connector comprises a slotted metal plate which may be used to form connections along a horizontal reinforcing member or between the reinforcing member and a facing element. The slot has a larger transverse dimension at one end and narrows toward its opposite end. A bolt, pin or connecting arm having a cross-sectional dimension which allows for insertion into the widest end of the slot, but which provides resistance upon movement toward the opposite end of the slot, is inserted through the slot, providing a connection between the metal plate and another component of the earth stabilizing structure. As the bolt, pin or connecting arm is moved toward the narrow end of the slot, it engages the edges of the slot and provides full design strength by mechanical interference. As an additional load beyond the anticipated design load is imposed, the bolt, pin or connecting arm is forced toward the narrow end of the slot, deforming the edges of the slot as it moves. After slipping, the connection returns to a condition of safe stress. The metal plate may be positioned at any point along a reinforcing member. It may also be positioned on a bracket which provides the connection point between a facing element and a reinforcing member. The plate may be either connected to or integrated within the bracket or reinforcing member.

31 Claims, 6 Drawing Sheets

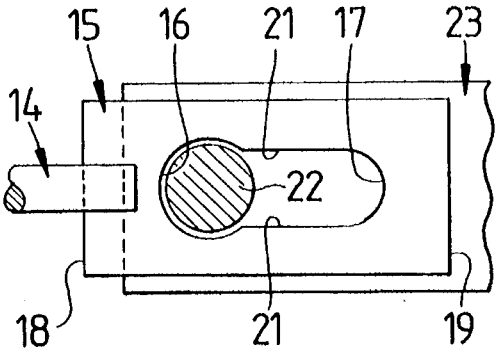
FIG. 4
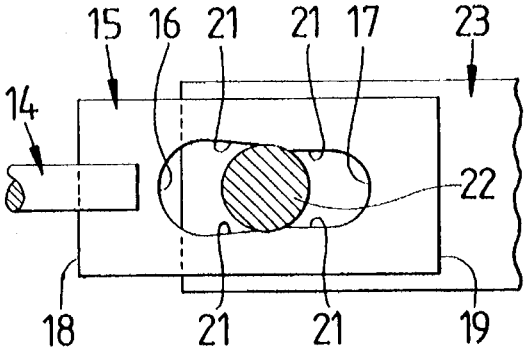
FIG. 5
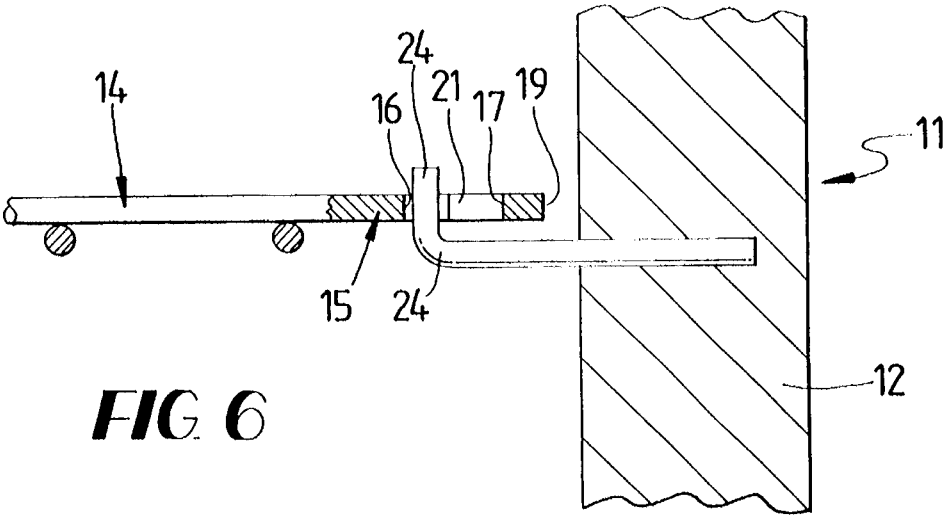
FIG. 6
FIG. 7
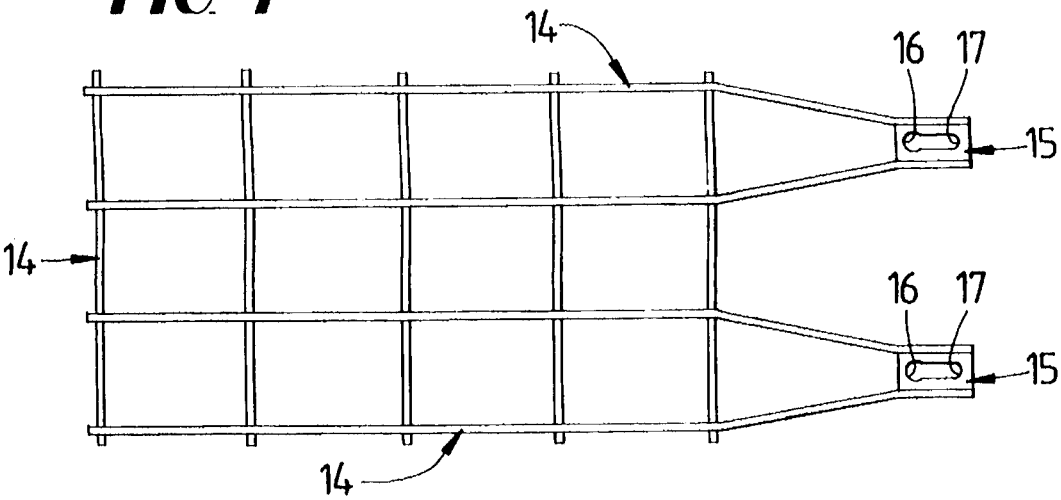

FAILURE PLANE
13
14
14
14
14
14
14
14

HORIZONTALLY-YIELDING EARTH STABILIZING STRUCTURE

FIELD OF THE INVENTION

The present invention relates to earth stabilizing structures and more particularly to a structure having horizontal reinforcing members. The reinforcing members may be wire mesh panels or elongated strips made from metal or any non-extensible material. The reinforcing members may each consist of more than one segment. The reinforcing members are embedded within backfill material to stabilize the earth mass, and may or may not be connected to facing elements. In even greater particularity, the present invention discloses a novel connector for coupling the components of the earth stabilizing structure such that the structure is capable of yielding horizontally to extraordinary horizontal impact loads without failing.

BACKGROUND OF THE INVENTION

Earth retaining structures are known in the general construction industry for containing backfill or earthen material. These retaining structures prevent the movement of fill material. The structures are particularly useful for retaining earthen material exposed in the construction of roads, highways, interchanges and parking lots. The structures may have facing elements which may be cast-in-place concrete, precast panel masonry units, wood or metal. The facing elements are held in place by reinforcing members which are typically metal strips, welded wire fabric or other non-extensible material. The reinforcing members are connected to the facing elements and extend rearwardly into the fill material. In some applications, facing elements are not used, and an earthen mass is stabilized by use of reinforcing members only. The reinforcing members engage with the fill material by friction, by interlocking, or by a combination of both friction and interlocking with the earthen mass. Many such structures have been rendered unsafe for continued service or have failed because they could not yield horizontally to unexpected loads. A common problem causing such excessive loads is over-compaction of the soil during construction, which in turn subjects the facing elements and reinforcing members to horizontal pressures greater than those considered in the design. Horizontal impact loads are also caused by events such as earthquakes, explosions and vehicle accidents. Attempts have been made to handle these horizontal impact loads by increasing the number of reinforcing members, increasing the strength of the connections between the facing elements and the reinforcing members, and designing the structures to withstand loads well beyond those theoretically expected. Although there has been some success with this approach, it significantly increases the cost of constructing the structures. If a stabilized earth structure is able to yield horizontally without failing in the face of these imposed horizontal stresses, the system would then redistribute the stresses to the earth mass and return to a stable and serviceable condition. A structure that is able to yield horizontally is capable of safely withstanding unexpected horizontal impact loads. Hilfiker, in U.S. Pat. No. 4,343,572, disclosed the use of deformable sections incorporated into welded wire mesh reinforcing members to accommodate horizontal loads. The deformable sections comprise a "zig-zag" in the wires extending rearwardly from the facing elements. The Hilfiker invention has a number of disadvantages. First, it is operative only with welded wire mesh panels. Secondly, it is limited to relief at or near the facing element. Further, it does not afford flexibility in terms of planning for a specific design stress.

SUMMARY OF THE PRESENT INVENTION

With the foregoing in mind, the principal object of the present invention is to provide an improved connector for a stabilized earth structure that enables the structure to yield horizontally and accordingly to withstand excessive short term forces without failing.

Another object of the invention is to provide a connector for an earth stabilizing structure that is capable of use with any type of non-extensible reinforcing member.

Yet another object of the invention is to provide a connector for an earth stabilizing structure which may be used to account for anticipated specific excessive loads in design of the structure.

A further object of the invention is to provide a yielding connector for an earth stabilizing structure which may be used to relieve stress at any point along a reinforcing member.

A still further object of the invention is to provide a yielding connector for an earth stabilizing structure which may be used to relieve stress at any point adjacent to or within the facing elements of the structure.

Another object of the invention is to provide a connector for an earth stabilizing structure which may be used to relieve stress at the connection point between the facing element and a reinforcing member.

Another object of the invention is to provide a connector for an earth stabilizing structure which provides a means for accounting for excessive horizontal loads in a cost-effective manner.

These and other objects of the present invention are accomplished through the use of a connector comprising a slotted metal plate. The slot is shaped so that it has a larger transverse dimension at one end and narrows toward its opposite end. A bolt, pin or connecting arm having a cross-sectional dimension which allows for insertion into the widest end of the slot, but which provides resistance upon movement toward the opposite end of the slot, is inserted through the slot, providing a connection between the metal plate and another component of the earth stabilizing structure. As the bolt, pin or connecting arm is moved toward the narrow end of the slot, it engages the edges of the slot and provides full design strength by mechanical interference. As an additional load beyond the anticipated design load is imposed, the bolt, pin or connecting arm is forced toward the narrow end of the slot, deforming the edges of the slot as it moves. This movement dissipates the extraordinary horizontal load. After slipping, the connection remains in a condition of safe stress. The metal plate may be positioned at any point along a reinforcing member. It may also be positioned on a bracket which provides the connection point between a facing element and a reinforcing member. The plate may be either connected to or integrated within the bracket or reinforcing member.

BRIEF DESCRIPTION OF THE DRAWINGS

The foregoing objects and advantages of the present invention for a yielding connector for an earth stabilizing structure will be more readily understood by one skilled in the art by referring to the following detailed description of a preferred embodiment and to the accompanying drawings which form a part of this disclosure, and wherein:

FIG. 4 is a top plan view of the metal plate of the present invention, showing a connecting bolt, pin or arm in its initial position within the slot.

FIG. 5 is a top plan view of the metal plate of the present invention, showing the connecting bolt, pin or arm deforming the edges of the slot after the connector has been subjected to an excessive horizontal impact load.

FIG. 6 is a sectional view showing a reinforcing member incorporating the metal plate of the present invention, connected to a facing element by a connecting arm.

FIG. 7 is a top plan view of the metal plate of the present invention, shown attached to the end of a reinforcing member comprising a wire mesh panel.

DETAILED DESCRIPTION OF THE PREFERRED EMBODIMENT

Figure 1:
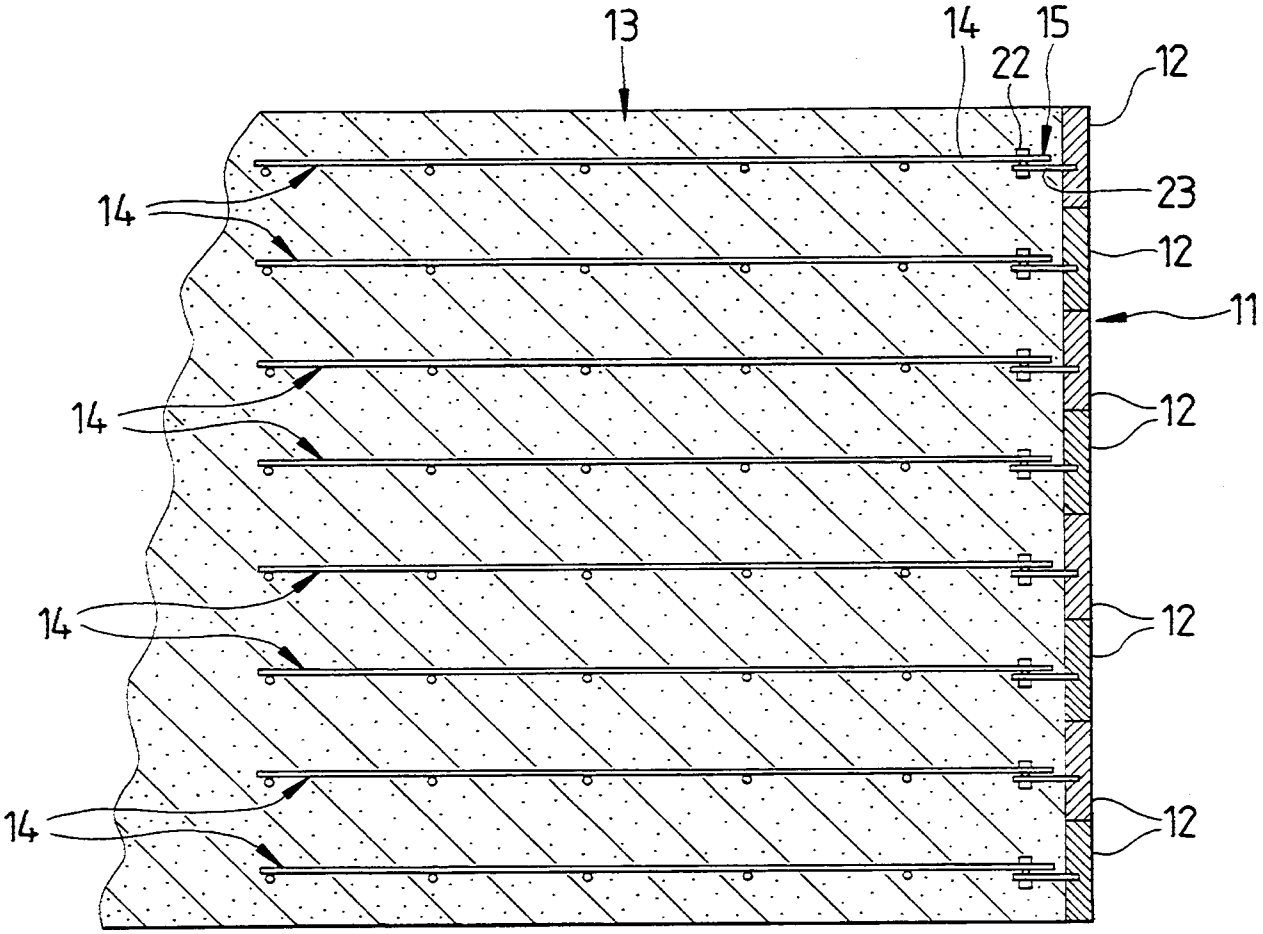
FIG. 1 is a sectional view of an earth stabilizing structure.

Referring to the drawings for a clearer understanding of the invention, FIG. 1 shows an earth stabilizing structure. On the front of the structure is an earth retaining wall 11, formed by a plurality of facing elements 12. Behind the wall 11 is a mass of particulate backfill material 13, which is stabilized by a plurality of horizontal reinforcing members 14 extending rearwardly from the facing elements 12 and embedded in the backfill 13.

Figure 2:
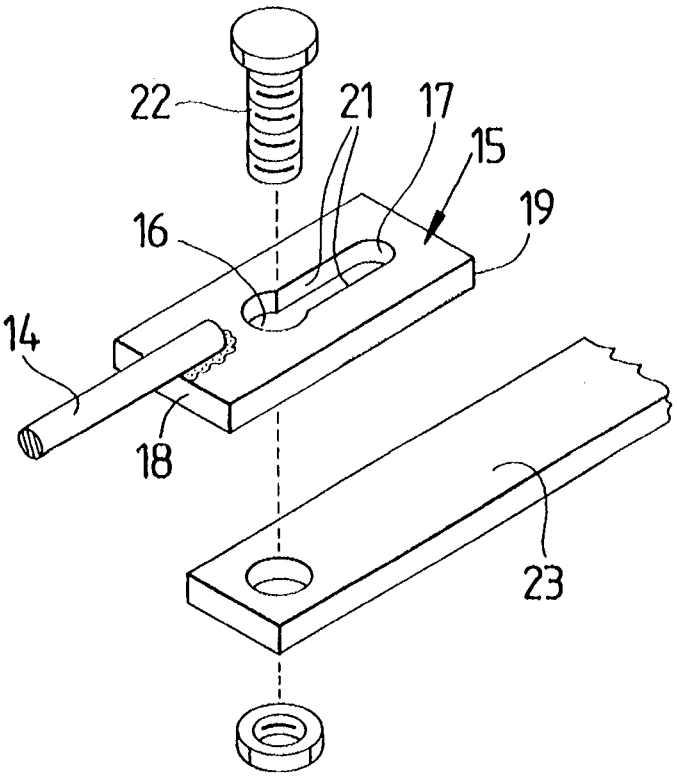
FIG. 2 is a perspective view of the preferred embodiment of the connector.

The connector of the present invention may be used at any point along a horizontal reinforcing member, or at the juncture between a reinforcing member and a facing element. As shown in FIG. 2, it comprises a slotted metal plate 15. The slot is specially shaped to allow the connection to hold at a given design strength, but to yield when subjected to an excessive impact load. In the preferred embodiment, the slot is keyhole-shaped, although the invention would be operative with a slot of any shape that narrows in width from one end to the other. The slot has an initial end 16 and a terminal end 17. The end of the metal plate nearest the initial end of the slot is its juncture end 18, and the end of the metal plate opposite the juncture end is its free end 19. The transverse dimension of the initial end 16 of the slot is greater than the transverse dimension of the terminal end 17. The connector is used with a connecting bolt having a cross-sectional dimension which permits it to be inserted through the initial end of the slot, but which is larger than the transverse dimension of the terminal end of the slot, such that as it moves toward the terminal end of the slot, the bolt engages the side edges 21 of the slot. A connecting pin, rod or arm may alternatively be used in place of the bolt to form the connection. The thickness of the metal plate and the strength of the metal from which it is made determine the resistance provided by the plate. The resistance must be sufficient to hold the bolt at the initial area of engagement with the side edges of the slot, without slipping, at a specific anticipated design load. Both the thickness and strength of the plate may be varied to suit the requirements of a particular job. When the earth stabilizing structure is subjected to an extraordinary horizontal impact load, such as that caused by an earthquake or explosion, the bolt is forced toward the terminal end of the slot, deforming the edges of the slot as it moves.

Figure 3:
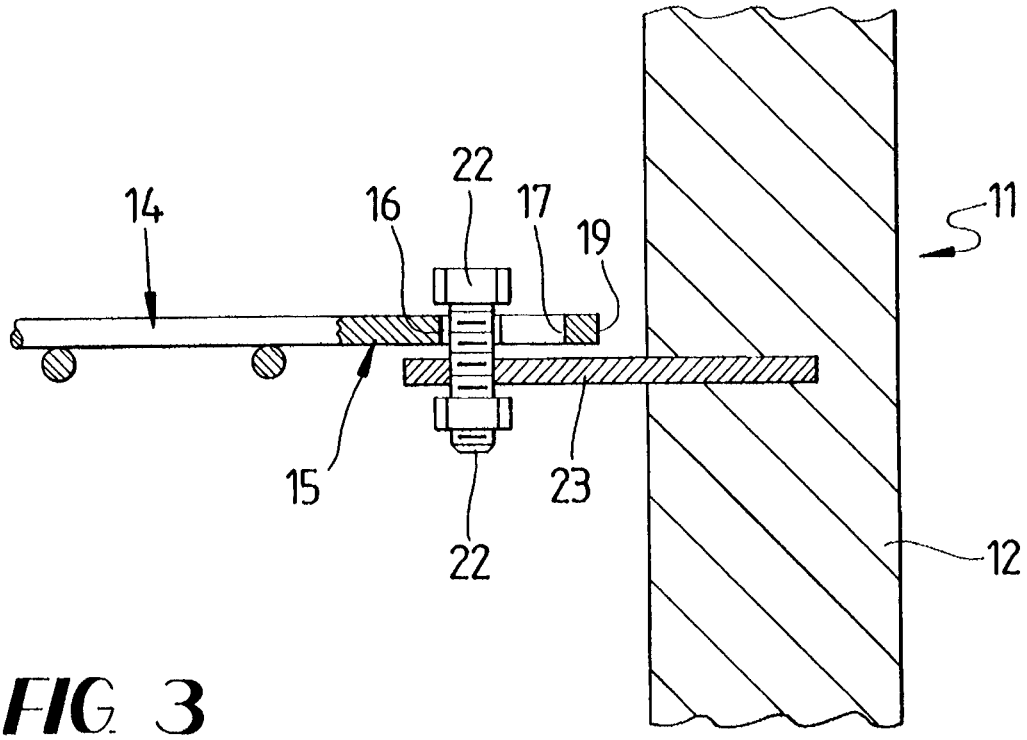
FIG. 3 is a sectional view of the connector, showing the use of a bolt to connect the metal plate to another component of the earth stabilizing structure.

The plate 15 may be welded to the reinforcing member 14, as shown in FIG. 2, or it may be integral with the reinforcing member as shown in FIG. 3. The plate may also be positioned on a bracket extending from, around or through a facing element.

FIG. 3 illustrates the use of a bolt 22 to join a reinforcing member 14 incorporating the metal plate 15 of the present invention to a bracket 23 extending from a facing element 12. As shown in FIG. 6, a bracket may be designed to have a laterally extending arm 24 so that the use of a connecting bolt is unneccessary. Likewise, if the slotted plate is attached to or incorporated within the connecting bracket, a reinforcing member with a laterally extending arm may be connected to the bracket without the need for a connecting bolt or pin.

Figure 8:
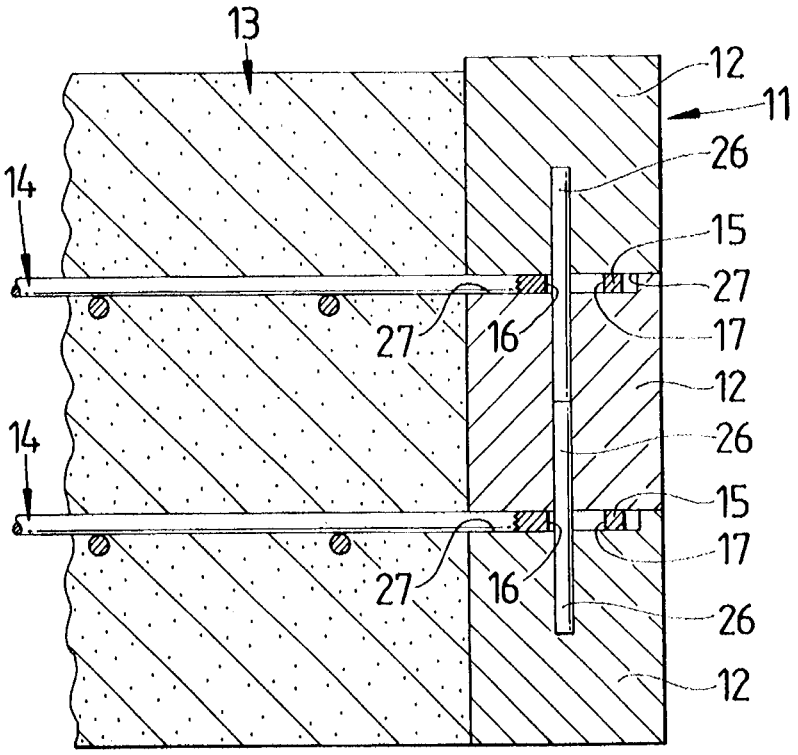
FIG. 8 is a sectional view of the present invention, showing the metal plate incorporated into the end of a reinforcing member positioned between facing elements and further showing a pin extending through the slot in the metal plate and into the adjacent facing elements to form a connection.
Figure 9:
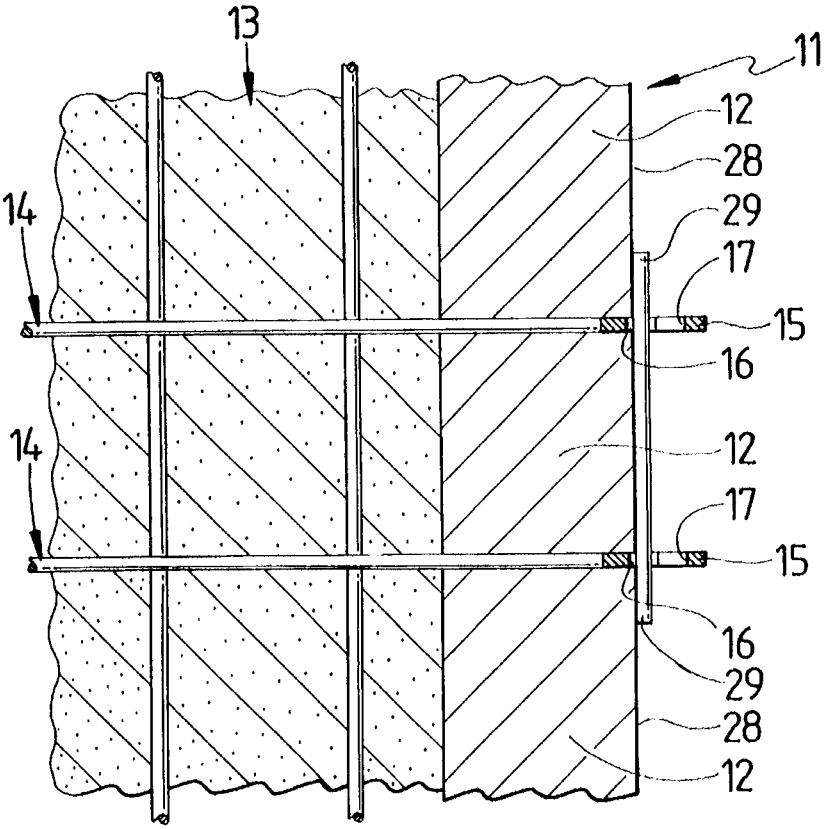
FIG. 9 is a sectional view of the present invention, showing the metal plate incorporated into the end of a reinforcing member extending through a facing element, and further showing a pin extending through the slot in the metal plate and along a surface of the facing element to form a connection.

FIG. 7 illustrates the metal plate 15 of the present invention connected to a wire mesh panel reinforcing member 14. The plate could alternatively be attached at an end of each of the wires extending rearwardly from the facing element, rather than being positioned between two of the wires as shown in the drawing. In FIG. 8, the end of a reinforcing member 14 incorporating the metal plate 15 of the present invention is shown extending between two vertically adjacent facing elements 12. A pin 26 extends outwardly from the peripheral surface 27 of one of the facing elements 12, through the initial end 16 of the slot in the metal plate 15 and into the peripheral surface 27 of the adjoining facing element 12. FIG. 9 illustrates another means of connecting reinforcing members to a facing element using the present invention. The metal plate 15 is positioned near the end of the reinforcing member 14. The reinforcing member 14 extends through the facing element 12 so that the metal plate 15 extends from the front surface 28 of the facing element 12. A connecting pin 29 is positioned parallel to and adjacent the front surface 28 of the facing element 12 and extends through the initial end 16 of the slot in the metal plate 15.

Figure 10:
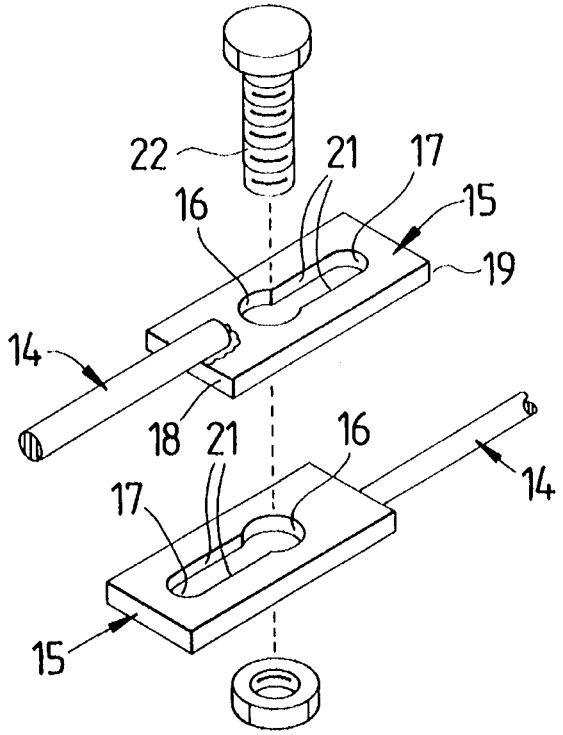
FIG. 10 is a sectional view of the present invention, showing two slotted metal plates fastened together with a bolt to form a yielding connection.

In FIG. 10, the slotted metal plate 15 of the present invention is shown connected by a bolt 22 to another slotted metal plate 15. The bolt 22 extends through the initial ends 16 of the slots in each of the plates 15. This arrangement may be used to join segments of a reinforcing member, or at the juncture between a facing element and a reinforcing member. Forming a connection in this manner increases the distance that the connection will yield when subjected to an excessive impact load.

Figure 11:
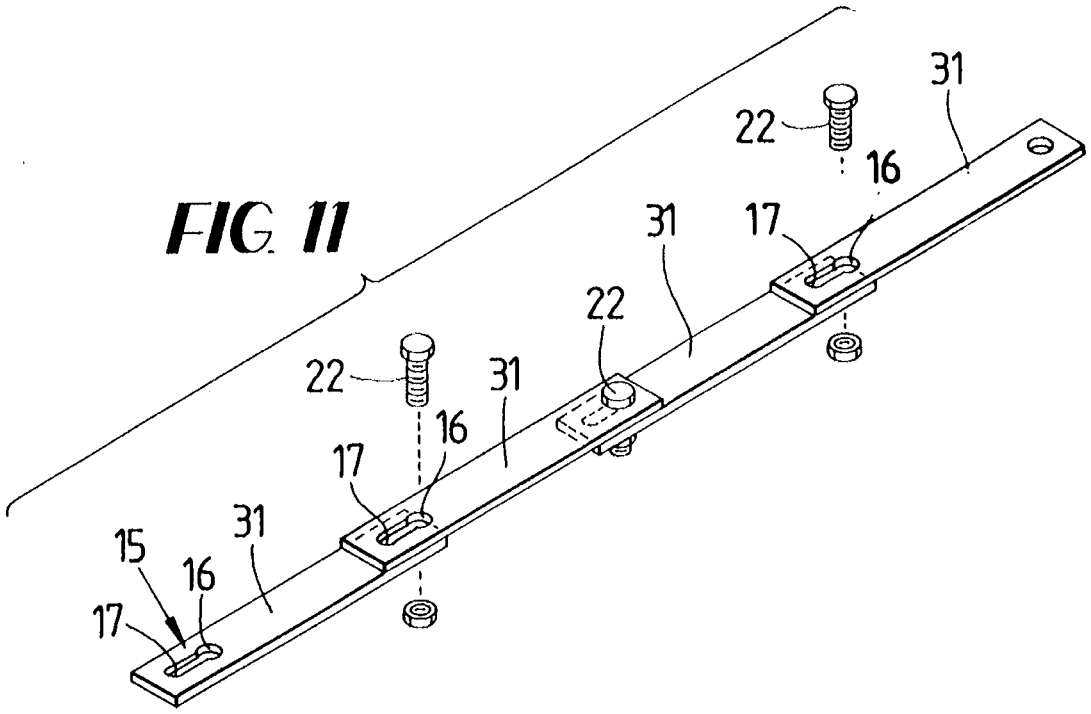
FIG. 11 is a sectional view of the present invention, showing the metal plate incorporated within segments of a reinforcing member.

The total distance that the structure will yield horizontally may also be increased by increasing the number of yielding connections. FIG. 11 illustrates the use of the connector at several points along a reinforcing member. As shown, each segment 31 of the reinforcing member 14 has the metal plate 15 of the present invention positioned at one end.

Figure 12:
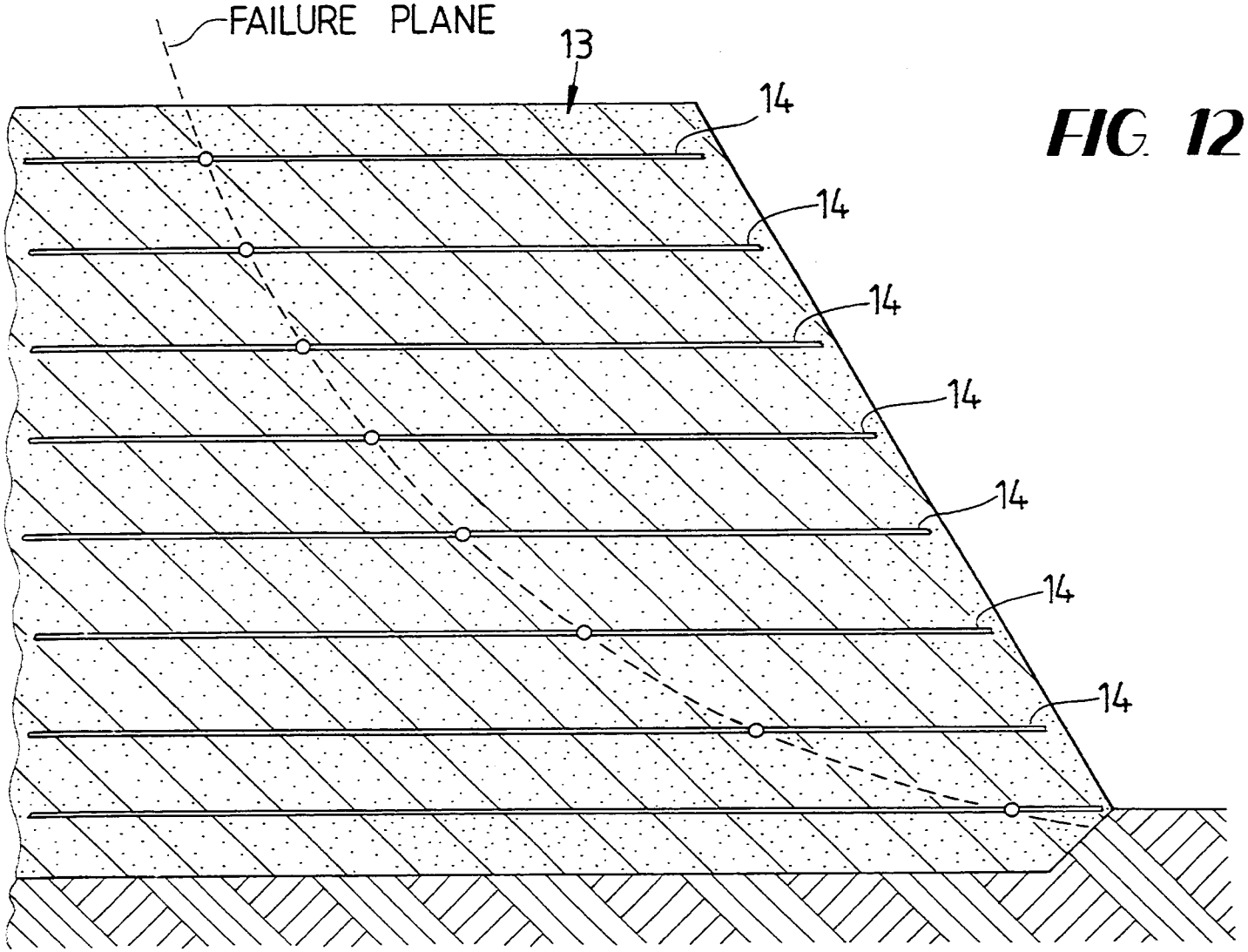
FIG. 12 is a sectional view of an oversteepened slope without facing elements, showing placement of the metal plate of the present invention on the reinforcing members along a potential failure plane. The dotted line represents the potential failure plane, and the circles represent the position of the yielding connector.

In some cases, a stabilized earth structure is constructed without the use of facing elements. In the case of an oversteepened slope, as shown in FIG. 12, the structure is stabilized by embedding horizontal reinforcing members 14 in layers in the fill material 13 of the structure. In such a structure, there is at least one potential failure plane along which the structure may fail if subjected to an excessive load. The connector of the present invention may be positioned at points on the reinforcing members along the potential failure plane, providing the structure with the ability to yield along the failure plane. The ability of the reinforcing members to extend horizontally will increase the impact load that the oversteepened slope may tolerate without failing.

While I have shown my invention in several forms, it will be obvious to those skilled in the art that it is not so limited but is susceptible of various changes and modifications without departing from the spirit thereof.

Having set forth the nature of the present invention, what I claim is:

1. A connector for use in an earth stabilizing structure, said earth stabilizing structure comprising at least one facing element and at least one reinforcing member extending rearwardly from said facing element, said connector affixed to said reinforcing member, said connector comprising a first metal plate having a slot defined therethrough, said slot having a longitudinal axis, an initial end and a terminal end, said initial end having a dimension transverse to said longitudinal axis which is larger than the transverse dimension of said terminal end of said slot.

2. A connector as defined in claim 1, further comprising:

(a) a connecting member, adjacent said first metal plate, said connecting member having an aperture therethrough; and (b) a connecting bolt, extending through said aperture in said connecting member and through said initial end of said slot in said first plate, said bolt having a cross-sectional dimension larger than the transverse dimension of said terminal end of said slot.

3. A connector as defined in claim 2, wherein said connecting member comprises a second metal plate and wherein said aperture in said connecting member is a slot having a longitudinal axis, an initial end and a terminal end, said initial end of said slot of said second plate having a dimension transverse to said longitudinal axis which is larger than the transverse dimension of said terminal end of said slot of said second plate, and wherein said connecting bolt extends through said initial ends of said slots of said first and second plates, and wherein said cross-sectional dimension of said bolt is larger than said transverse dimension of said terminal end of said slot of said second plate.

4. A connector as defined in claim 1, wherein said reinforcing member of said earth stabilizing structure has an end proximal said facing element and wherein said metal plate is connected to said proximal end of said reinforcing member at an end of said metal plate proximal said initial end of said slot.

5. A connector as defined in claim 1, wherein said connector is integral to said reinforcing member.

6. A connector as defined in claim 5, wherein said connector is positioned at an end of said reinforcing member proximal to said facing element.

7. A connector as defined in claim 1, wherein said reinforcing member comprises a plurality of segments and wherein said metal plate is connected to an end of one of said segments.

8. A connector as defined in claim 4, wherein said facing element has a front surface, a backfill surface and a peripheral surface intermediate said front and backfill surfaces, and wherein said proximal end of said reinforcing element and said metal plate are adjacent said peripheral surface, further comprising a connecting rod extending through said initial end of said slot and into said facing element at a position on said peripheral surface of said facing element.

9. A connector as defined in claim 4, wherein said facing element has a front surface and a backfill surface and wherein said reinforcing element extends through said facing element such that said proximal end of said reinforcing element and said metal plate extend outwardly from said front surface of said facing element, further comprising a rod, positioned substantially parallel to said front surface of said facing element and extending through said initial end of said slot.

10. A connector as defined in claim 1, further comprising an L-shaped connecting member, having a first arm and a slot-engaging arm, said slot-engaging arm having a cross-sectional dimension larger than said transverse dimension of said terminal end of said slot and said slot-engaging arm extending through said initial end of said slot in said metal plate.

11. A connector as defined in claim 10, wherein said first arm is connected to said facing element.

12. A connector as defined in claim 10, wherein said first arm is connected to said reinforcing member.

13. A connector for use in a structure for stabilizing a mass of earth, said structure comprising a plurality of horizontal reinforcing members positioned at varying heights within said mass of earth, each of said reinforcing members having a first segment and a second segment, comprising:

(a) a metal plate having a slot defined therethrough, said slot having a longitudinal axis, an initial end and a terminal end, said initial end having a dimension transverse to said longitudinal axis which is larger than the transverse dimension of said terminal end of said slot, said metal plate being connected at an end thereof proximal said initial end of said slot to an end of said first segment of said reinforcing member; and (b) means extending through said initial end of said slot for joining said second segment to said first segment, said joining means having a cross-sectional dimension larger than the transverse dimension of said terminal end of said slot.

14. A connector as defined in claim 13, wherein said joining means comprises a connecting bolt.

15. A connector as defined in claim 13 wherein said second segment has a longitudinal axis and said joining means comprises an arm extending laterally from said longitudinal axis.

16. An apparatus for coupling the components of an earth stabilizing structure, said structure including a facing element having a front surface, a backfill surface and a peripheral surface intermediate said front and backfill surfaces, said structure further including a reinforcing member extending rearwardly from said facing element, comprising:

(a) a metal plate having a slot defined therethrough, said slot having a longitudinal axis, an initial end and a terminal end, said initial end having a dimension transverse to said longitudinal axis which is larger than the transverse dimension of said terminal end of said slot, said plate further having a juncture end and a free end, said juncture end proximal said initial end of said slot and said free end proximal said terminal end of said slot; and (b) means, extending through said initial end of said slot for connecting a component of said earth stabilizing structure to said metal plate, said means having a cross-sectional dimension at the point where said means extends through said slot which is larger than the transverse dimension of said terminal end of said slot.

17. An apparatus as defined in claim 16, wherein said juncture end of said metal plate is connected to an end of said reinforcing member proximal said facing element.

18. An apparatus as defined in claim 17, wherein said metal plate is positioned adjacent to said backfill surface of said facing element.

19. An apparatus as defined in claim 17, wherein said reinforcing member extends through said facing element from said backfill surface through said front surface such that said metal plate protrudes through said front surface of said facing element.

20. An apparatus as defined in claim 17, wherein said reinforcing member is positioned such that said metal plate is adjacent said peripheral surface of said facing element.

21. An apparatus as defined in claim 16, wherein said reinforcing member comprises a plurality of segments, and wherein said metal plate is connected at said juncture end of said plate to an end of one of said segments.

22. An apparatus as defined in claim 16, wherein said connecting means comprises a connecting pin.

23. An apparatus as defined in claim 18, wherein said connecting means comprises a bolt, and wherein said earth stabilizing structure further comprises a bracket for holding said facing element in place, said bracket having at least one arm extending rearwardly from said backfill surface of said facing element, said arm having an aperture therethrough for receiving said bolt, and wherein said bolt extends through said aperture in said arm and through said slot in said metal plate.

24. An apparatus as defined in claim 19 wherein said means comprises a connecting pin, positioned adjacent and substantially parallel to said front surface of said facing element.

25. An apparatus as defined in claim 20, wherein said connecting means comprises a pin, positioned substantially perpendicular to said peripheral surface of said facing element, said pin extending through said slot in said metal plate and into said peripheral surface of said facing element.

26. An apparatus as defined in claim 25, wherein said earth stabilizing structure further comprises a second facing element having a front surface, a backfill surface and a peripheral surface, said second facing element positioned such that its peripheral surface is adjacent said peripheral surface of said first facing element, and wherein said pin extends through said slot in said metal plate and into said peripheral surface of said second facing element.

27. A connector for use in an earth stabilizing structure, said earth stabilizing structure comprising at least one facing element and at least one reinforcing member extending rearwardly from said facing element, said connector affixed to said facing element, said connector comprising a first metal plate having a slot defined therethrough, said slot having a longitudinal axis, an initial end and a terminal end, said initial end having a dimension transverse to said longitudinal axis which is larger than the transverse dimension of said terminal end of said slot.

28. A connector as defined in claim 27, further comprising an L-shaped connecting member, having a first arm and a slot-engaging arm, said slot-engaging arm having a cross-sectional dimension larger than said transverse dimension of said terminal end of said slot and said slot-engaging arm extending through said initial end of said slot in said metal plate.

29. A connector as defined in claim 28, wherein said first arm is connected to said reinforcing member.

30. A connector as defined in claim 27, further comprising:

(a) a connecting member, adjacent said first metal plate, said connecting member having an aperture therethrough; and (b) a connecting bolt, extending through said aperture in said connecting member and through said initial end of said slot in said first plate, said bolt having a cross-sectional dimension larger than the transverse dimension of said terminal end of said slot.

31. A connector as defined in claim 30, wherein said connecting member comprises a bracket attached to said facing element.

* * * * *